US006917344B2

(12) United States Patent
Zimmerman et al.

(10) Patent No.: US 6,917,344 B2
(45) Date of Patent: Jul. 12, 2005

(54) SYSTEM FOR ISOLATING AN AUXILIARY ANTENNA FROM A MAIN ANTENNA MOUNTED IN A COMMON ANTENNA ASSEMBLY

(75) Inventors: Martin L. Zimmerman, Chicago, IL (US); Kevin E. Linehan, Lemont, IL (US); Thomas E. Charlton, Sedona, AZ (US)

(73) Assignee: Andrew Corporation, Orland Park, IL (US)

( * ) Notice: Subject to any disclaimer, the term of this patent is extended or adjusted under 35 U.S.C. 154(b) by 84 days.

(21) Appl. No.: 10/261,809

(22) Filed: Oct. 1, 2002

(65) Prior Publication Data

US 2003/0193441 A1 Oct. 16, 2003

Related U.S. Application Data

(60) Provisional application No. 60/372,130, filed on Apr. 12, 2002.

(51) Int. Cl.[7] ..... H01Q 1/52

(52) U.S. Cl. ..... 343/841; 343/815; 343/851; 343/853; 343/890

(58) Field of Search ..... 343/815, 841, 343/851, 853, 890, 795

(56) References Cited

U.S. PATENT DOCUMENTS

| | | | | |
|---|---|---|---|---|
| 4,329,690 | A * | 5/1982 | Parker | 343/709 |
| 5,038,151 | A * | 8/1991 | Kaminski | 343/727 |
| 6,282,427 | B1 | 8/2001 | Larsson et al. | 455/456 |
| 6,295,455 | B1 | 9/2001 | Fischer et al. | 455/456 |
| 2001/0009857 | A1 | 7/2001 | Vanttinen | 455/456 |
| 2001/0039192 | A1 | 11/2001 | Osterling et al. | 455/502 |
| 2002/0027993 | A1 | 3/2002 | Vanttinen | 380/258 |
| 2002/0041575 | A1 | 4/2002 | Amirijoo et al. | 455/456 |

* cited by examiner

*Primary Examiner*—Michael C. Wimer
(74) *Attorney, Agent, or Firm*—Barnes & Thornburg

(57) ABSTRACT

A radio frequency antenna structure includes a base station antenna and an auxiliary antenna mounted within a common antenna assembly. The base station antenna is configured to transmit or receive signals in a first frequency range and to develop a main beam that is substantially wider in azimuth than in elevation, and the auxiliary antenna is configured to transmit or receive signals in a second frequency range at least partially overlapping the first frequency range and to develop an auxiliary beam at least partially overlapping the main beam. Means are included for decoupling the base station and auxiliary antennas to thereby suppress interference between the main and auxiliary beams, and for suppressing interference between the auxiliary antenna and any co-located antennas.

16 Claims, 5 Drawing Sheets

SYSTEM FOR ISOLATING AN AUXILIARY ANTENNA FROM A MAIN ANTENNA MOUNTED IN A COMMON ANTENNA ASSEMBLY

CROSS-REFERENCE TO RELATED APPLICATIONS

This application claims priority to, and the benefit of, U.S. provisional patent application Ser. No. 60/372,130, filed Apr. 12, 2002, the disclosure of which is incorporated herein by reference.

FIELD OF THE INVENTION

The present invention relates generally to antenna systems for radio communications equipment, and more specifically to techniques for isolating an auxiliary antenna from a main antenna mounted in a common antenna assembly.

BACKGROUND AND SUMMARY OF THE INVENTION

Recent regulations promulgated by the Federal Communications Commission (FCC) require wireless telephone service providers within the United States to implement Emergency 911 location service for identifying the location of a mobile user making a 911 call. In providing such service, a location measurement unit (LMU) antenna is used, wherein the LMU antenna in the communications system must be isolated from co-located transmitting antennas so that signals from neighboring cell sites are not drowned out. Although physically separating the LMU antenna from co-located antennas on an antenna tower may provide some isolation, the limited space on typical antenna tower platforms prevents physically separating such antennas by distances great enough to provide necessary isolation.

Isolation of an auxiliary antenna, such as an LMU antenna, from a main antenna, such as a base station antenna, mounted within a common antenna assembly is non-trivial, particularly when the transmitting and/or receiving frequency range of the auxiliary antenna at least partially overlaps the transmitting and/or receiving frequency range of the main antenna.

The present invention is accordingly directed to an antenna system for isolating an auxiliary antenna, such as an LMU antenna, from a main antenna, such as a base station antenna, mounted within a common antenna assembly, and also from other co-located antennas mounted to an antenna tower.

The present invention comprises one or more of the following features or combinations thereof. A main antenna, such as a base station antenna, and an auxiliary antenna, such as an LMU antenna, are mounted within a common antenna assembly. The main antenna may be configured to transmit or receive signals in a first range of radio frequencies, and to develop a main beam that is substantially wider in azimuth than in elevation. The main beam may define a beam elevation configured to communicate with mobile terminals. The auxiliary antenna may be configured to transmit or receive signals in a second frequency range at least partially overlapping the first frequency range, and to develop an auxiliary beam at least partially overlapping the main beam. The auxiliary antenna may be configured to communicate with co-located or remote base station antennas. The auxiliary beam may be substantially wider in azimuth than the main beam, and/or may be omnidirectional. The auxiliary antenna may be positioned elevationally above or below the main antenna.

The main and axiliary antennas may define a apace therebetween sized to decouple the main and auxiliary antennas and minimize interference therebetween. The space may include a radio frequency energy absorbing member and/or a radio frequency energy scattering member operable to decouple the antennas to suppress interference between the main and auxiliary beams. The radio frequency energy absorbing member may be formed of a material configured to absorb energy in the second frequency range. The radio frequency energy scattering member may be a radio frequency range. The radio frequency energy scattering member may be a radio frequency choke structure which may comprise a body defining at least one slot between a pair of electrically conductive plates each defining a channel therethrough, each of said plates defining a length of about one quarter of the wavelength of said second frequency range between an outer periphery thereof and an outer periphery of said channel.

The auxiliary antenna may comprise one or more radiator elements that may be designed so as to minimize transfer of energy to the main antenna, for example, by suppressing the signals radiated by the auxiliary antenna in the direction of the main beam of the main antenna.

The auxiliary antenna may include one or more energy absorbing members positioned about the one or more radiator elements to absorb energy on the second frequency range transmitted or received by the auxiliary antenna to thereby isolate the auxiliary antenna from other co-located antennas.

The main antenna may be positioned adjacent to a second ground plate isolated from the first ground plate. The main antenna may or may not be mounted to the first ground plate, and the auxiliary may or may not be mounted to the second ground plate.

An electrically non-conductive support structure may be provided to interconnect the main and auxiliary antennas by uniting the first and second ground plates and/or the main and auxiliary antennas. The non-conductive support structure may comprise an electrically non-conductive elongated member interconnecting the first and second ground plates and/or the main and auxiliary antennas.

Such an antenna system may comprise part of a multi-antenna installation having an antenna tower including a number of antenna mounting platforms each having one or more signal receiving and/or signal transmitting antennas mounted thereto. Such an antenna system may be mounted to any one of the number of antenna mounting platforms.

These and other features of the present invention will become more apparent from the following description of the illustrative embodiments.

DESCRIPTION OF THE ILLUSTRATIVE EMBODIMENTS

Figure 1:
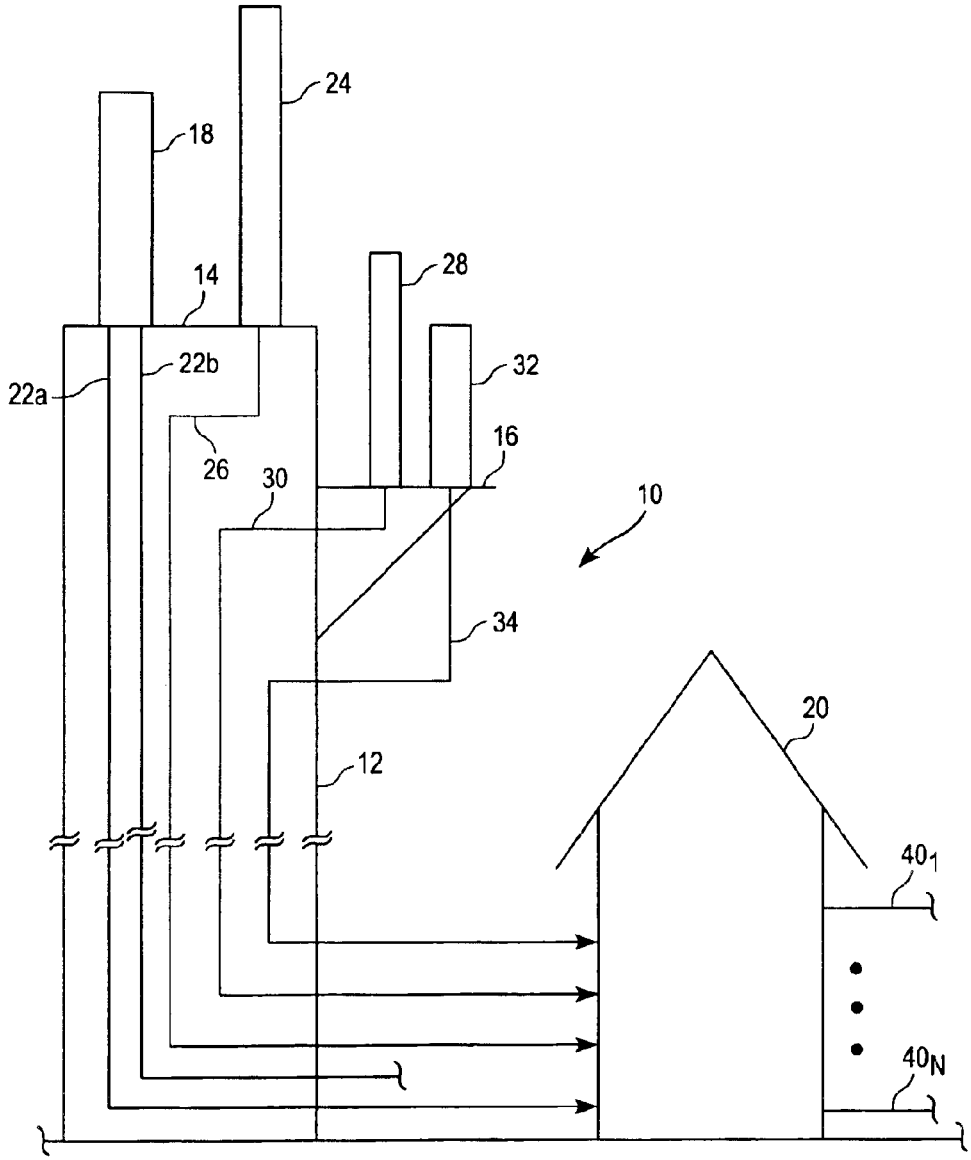
FIG. 1 is as diagrammatic illustration of an antenna tower having a number of signal transmitting and/or receiving antennas mounted thereto including a combination main antenna and auxiliary antenna.

For the purposes of promoting an understanding of the principles of the invention, reference will now be made to a number of embodiments illustrated in the drawings and specific language will be used to describe the same. It will nevertheless be understood that no limitation of the scope of the invention is thereby intended.

Referring now to FIG. 1, a diagrammatic illustration of a signal receiving arrangement 10, including and antenna tower 12 having a number of antennas mounted thereto including a combination main antenna and auxiliary antenna 18, is shown. Arrangement 10 includes a tower 12 defining a number of tower platforms 14 and 16 configured for mounting one or more signal receiving and/or transmitting antennas thereto. In the embodiment shown, platform 14 has two such antennas mounted thereto; namely a combination main antenna and auxiliary antenna assembly 18 and another signal receiving and/or transmitting antenna 24. Antenna assembly 18 includes two transmission lines 22*a* and 22*b* connected thereto, wherein transmission line 22*a* is connected to a signal processing station 20 and transmission line 22*b* is configured for connection to other signal processing equipment (not shown). In one embodiment, as will be described in greater detail hereinafter, the main antenna of antenna assembly 18 may be a base station antenna connected to transmission line 22*a*, and in this embodiment the signal processing stations 20 may be a conventional base station. The auxiliary antenna of antenna assembly 18 in this embodiment may be, for example, a location measurement unit (LMU) antenna connected to transmission line 22*b*, and in this embodiment transmission line 22*b* is connectable to appropriate known signal processing equipment. Antenna 24 is also connected to signal processing station 20 via transmission line 26. Platform 16 likewise has two antennas mounted thereto; namely a first signal receiving and/or transmitting antenna 28 and a second signal receiving and/or transmitting antenna 32. Antenna 28 is connected to signal processing station 20 via transmission line 30, and antenna 32 is connected to signal processing station via transmission line 34. The signal processing station 20 is operable, as is known in the art, to receive incoming signals on any one or more of the transmission lines 22*a*, 26 30 and 34, and perform signal evaluation, diagnostics and/or processing prior to providing such signals to users via any one or more of a number, $N_1$ of signal transmission lines $\mathbf{40}_1$–$\mathbf{40}_N$, wherein N may be any positive integer. Signal processing station 20 is further operable, as is known in the art, to receive incoming signals on any one or more of the transmission lines $\mathbf{40}_1$–$\mathbf{40}_N$, and perform signal evaluation, diagnostics and/or processing prior to providing such signals to appropriate ones of antennas 18, 22*a*, 24, 28, and 32 that are configured as signal transmitting antennas.

Figure 2:
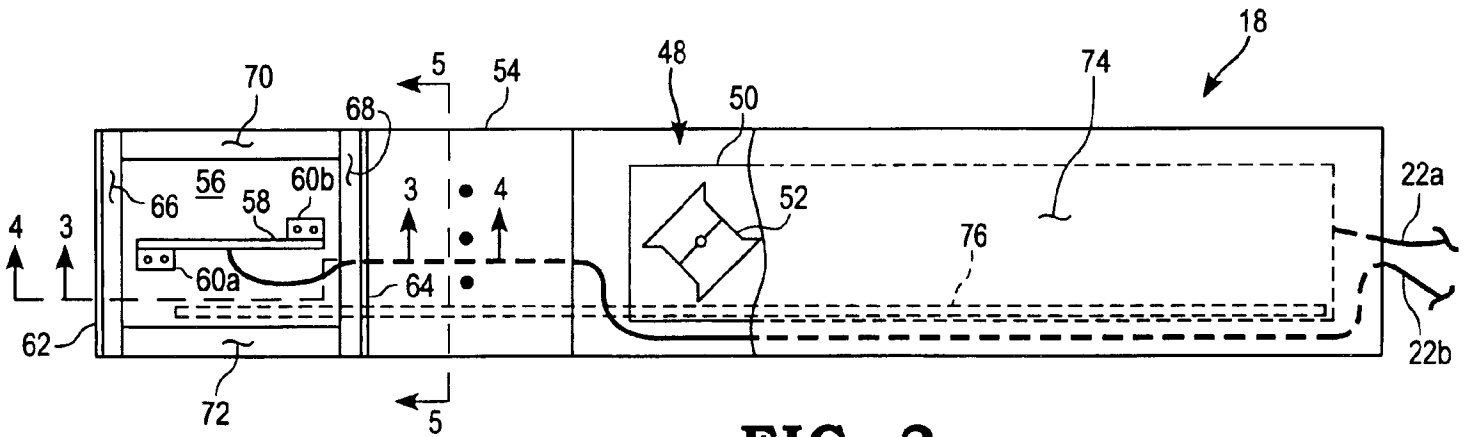
FIG. 2 is a partial cutaway view of one illustrative embodiment of the combination main antenna and auxiliary antenna of FIG. 1.

Referring now to FIG. 2, a partial cutaway view of one embodiment of the combination main antenna and auxiliary antenna assembly 18 of FIG. 1 is shown. Antenna assembly 18 is illustrated lying on one of its sides in FIG. 2, and includes a main antenna 48 of known construction including a ground plane or plate 50 having a number of radiator elements 52 mounted thereto (only one shown in FIG. 2) or adjacent thereto, and electrically connected together in a known manner to form a main antenna 48. Transmission line 22*a* is electrically connected to main antenna 48 in a known manner, and provides the signal feed path for this antenna. In the embodiment shown, main antenna 48 is approximately four feet in length, although other lengths and configurations of main antenna 48 are contemplated.

Antenna 18 further includes an auxiliary antenna 58 mounted to, or adjacent to, a ground plane or plate 56. In the illustrated embodiment, antenna 58 is mounted to the ground plane 56 via a pair of mounting brackets 60*a* and 60*b*, although other embodiments are contemplated wherein antenna 58 is mounted to some other structure and disposed adjacent to the ground plane or plate 56. Ground plane or plate 56 defines at one end a first ear 62 extending generally upwardly and away from ground plane or plate 56, and at an opposite end a second ear 64 also extending generally upwardly away from the ground plane or plate 56 (see also FIGS. 3 and 4). The ground plane or plate 56 is, in the embodiment shown, formed of an electrically conductive material such as aluminum, although plane or plate 56 may be formed of other known materials including, for example, an electrically insulating material having an electrically conductive coating or sheet adhered thereto.

Figure 3:
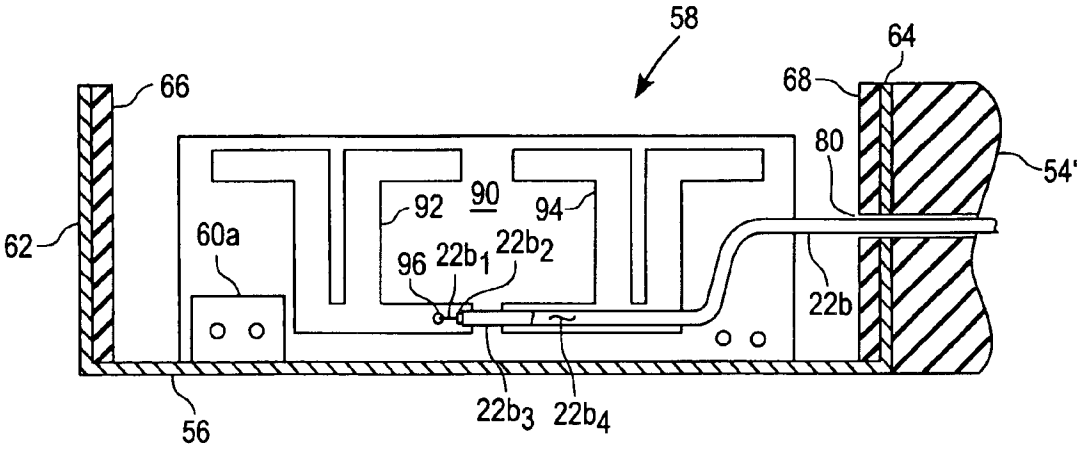
FIG. 3 is a cross-sectional view of the antenna combination of FIG. 2 viewed along section lines 3—3 showing details of one illustrative embodiment of the auxiliary antenna, and also showing one illustrative embodiment of an antenna isolation member positioned between the auxiliary antenna and the main antenna.
Figure 4:
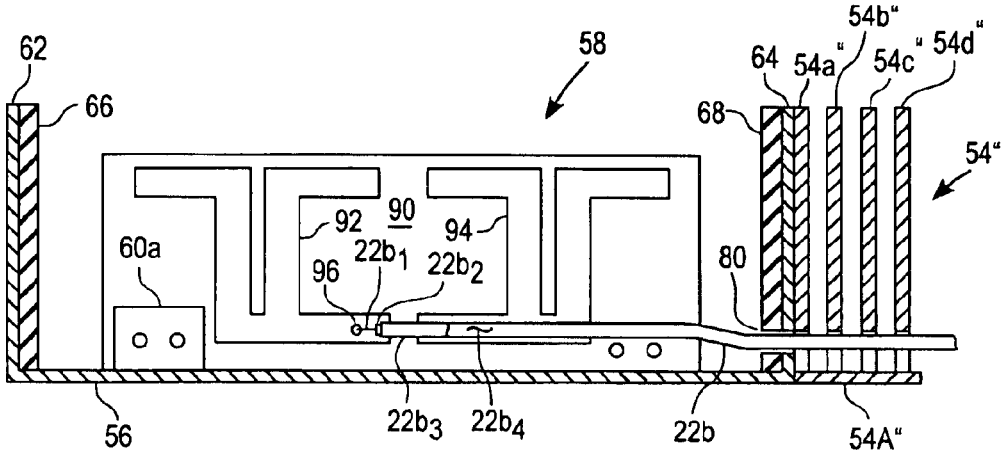
FIG. 4 is a cross-sectional view of the antenna combination of FIG. 2 viewed along section lines 4—4 illustrating another embodiment of an antenna.

Referring now to FIGS. 3 and 4, a cross-sectional view of the antenna assembly 18 of FIG. 2 is shown, as viewed along section lines 3—3 and 4—4, and illustrates one embodiment of the configuration of the auxiliary antenna 58. In the embodiment illustrated in FIGS. 3 and 4, the auxiliary antenna 58 is configured as a location measurement (LMU) antenna 58, although it is to be understood that antenna 58 may take on alternate antenna configurations generally operable as described herein. Antenna 58 illustrated in FIGS. 3 and 4 includes a pair of electrically conductive radiator elements 92 and 94 formed on one side of an electrically insulating plate 90. In one embodiment, plate 90 is formed from conventional circuit board material, and radiator elements 92 and 94 are formed in thin strips from a copper alloy deposited, plated or otherwise formed on plate 90 using known techniques. It will be understood, however, that the present invention contemplates forming plate 90 of any known electrically insulating material suitable for supporting radiator elements 92 and 94, and further contemplates forming radiator elements 92 and 94 of any known electrically conductive material. In the embodiment shown, transmission line 22*b* comprises a conventional coaxial transmission cable including an inner conductor $\mathbf{22}b_1$ and an outer conductor $\mathbf{22}b_3$ separated by an electrically insulating member $\mathbf{22}b_2$. An electrically insulating sleeve $\mathbf{22}b_4$ surrounds outer conductor $\mathbf{22}b_3$. Plate 90 defines on the side opposite of that defining radiator elements 92 and 94 (not shown) a conventional signal combining structure, such as a number of microstrip transmission lines, that combine the signals received by radiator elements 92 and 94 into a single signal in a known manner. Plate 90 defines a bore 96 therethrough, and the inner conductor $\mathbf{22}b_1$ of transmission line 22*b* extends through bore 96 into electrical connection with the signal combining structure defined on the opposite side of plate 90. The outer conductor $\mathbf{22}b_3$ of transmission line 22*b* is electrically connected to elements 92 and 94 on the side of plate 90 illustrated in FIGS. 3 and 4. Transmission line 22*b* is routed around the main antenna 48 and exits antenna 18 adjacent to transmission line 22*a*.

In one embodiment, antenna assembly 18 is configured to be mounted to an antenna tower or other suitable mounting structure in a vertical orientation as illustrated in FIG. 1, although other mounting orientations are contemplated. Antenna assembly 18 has a back side opposite radiator elements 52 and auxiliary antenna 58 (not shown) that may be configured for mounting the antenna assembly 18 to a suitable mounting structure. Alternatively, either or both of the opposing ends of antenna assembly 18 may be configured for mounting to a suitable mounting structure.

Figure 6:
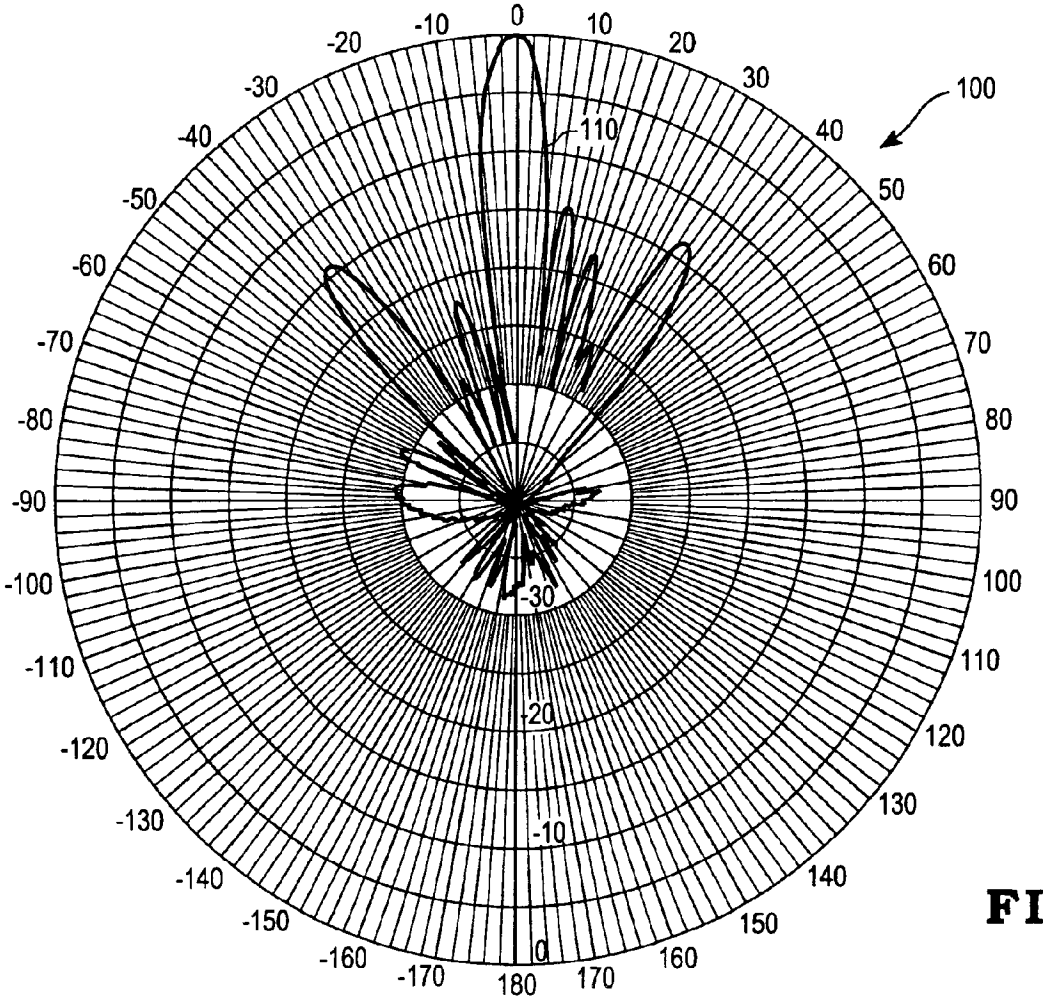
FIG. 6 is a polar plot of an example main beam signal developed by the main antenna of FIG. 2.

The main antenna 48 is configured, in one embodiment, to develop a main beam that is substantially wider in azimuth than in elevation, and may further define a beam elevation configured to communicate with mobile terminals. Referring to FIG. 6, for example, a polar plot is shown illustrating such a main beam 100 developed by main antenna 48, with antenna assembly 18 mounted in a vertical orientation as illustrated in FIG. 1. In the polar plot, –90 corresponds directionally to vertically upwards and 90 corresponds to vertically downwards. As illustrated in FIG. 6, the main beam 100 developed by antenna 48 in this embodiment is highly directional, having a main lobe 110 extending generally normal to the vertically oriented antenna assembly 18 with a small number of side lobes tightly distributed about the main lobe 110. In one embodiment, the main antenna 48 is a base station antenna configured to transmit main beam 100 in a narrow beam pattern (e.g., approximately 65 degrees, with main lobe 110 spanning approximately 7 degrees) directed horizontally and/or below for communication with mobile terminals, although wider beam patterns and orientations are contemplated. In any case, main antenna 48 is configured to transmit or receive signals in a first frequency range of interest, e.g., on the order of 1500–2000 MHz.

Figure 7:
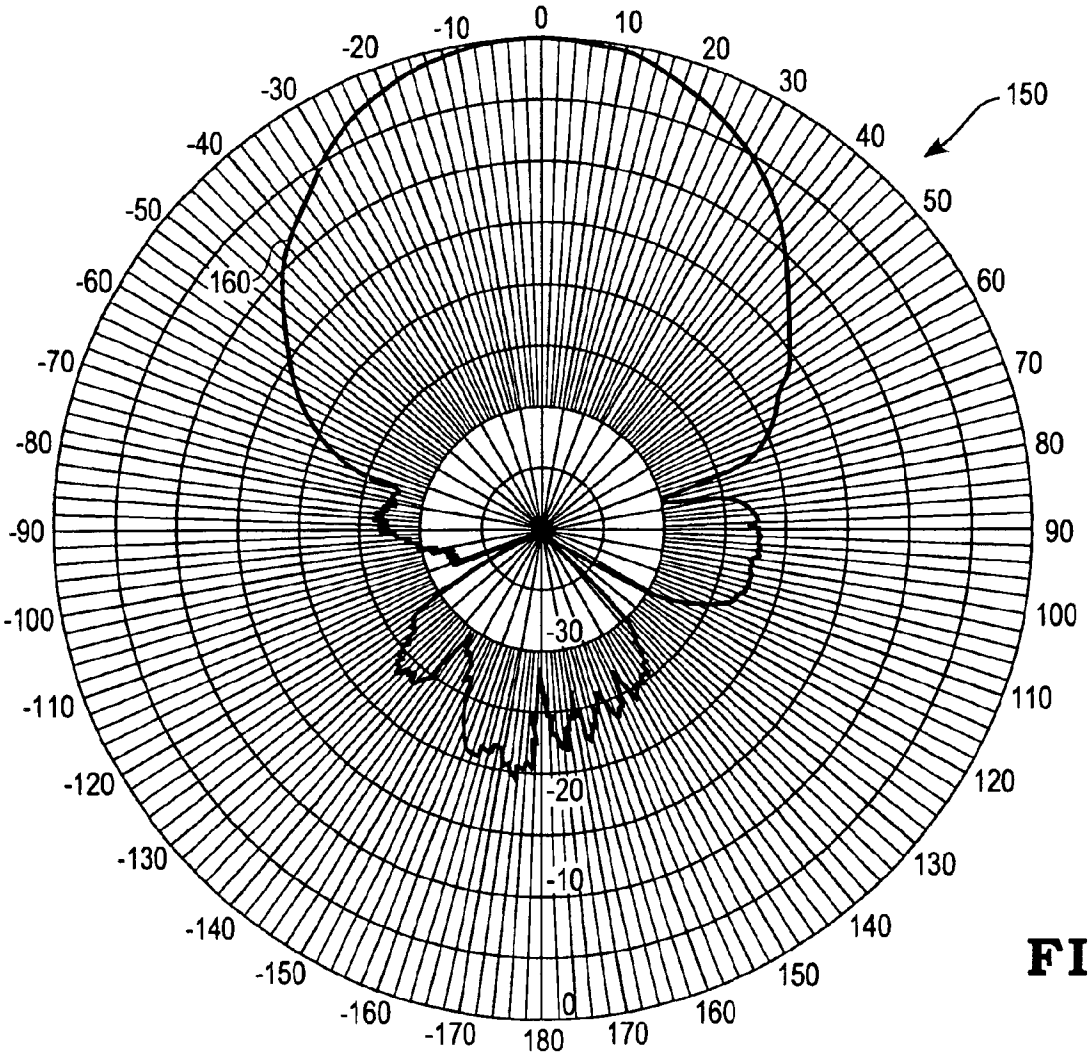
FIG. 7 is a polar plot of an example auxiliary beam signal developed by the auxiliary antenna of FIG. 2.

The auxiliary antenna 58 is configured, in one embodiment, to receive signals from base station antennas other than main antenna 48 that are within range, although antenna 58 may alternatively be configured to transmit radio frequency signals. As with main antenna 48, auxiliary antenna 58 may be configured to develop an auxiliary beam that is substantially wider in azimuth than in elevation, and an example of such an auxiliary beam 150 produced by auxiliary antenna 58 is illustrated in the polar plot of FIG. 7, wherein antenna assembly 18 is oriented identically as that which produced the polar plot of FIG. 6. As in the polar plot of FIG. 6, –90 in FIG. 7 corresponds directionally to vertically upwards and 90 corresponds to vertically downwards. The auxiliary beam 150 developed by antenna 58 in this embodiment is directional, although less so than that of main beam 100 of FIG. 6, and has an auxiliary lobe 160 extending generally normal to the vertically oriented antenna assembly 18 with a number of small side lobes distributed about the main lobe 160. In one embodiment, the auxiliary antenna 58 is a location measurement unit (LMU) antenna configured to transmit auxiliary beam 150 in a beam pattern spanning approximately 135 degrees as generally illustrated in FIG. 7, although antenna 58 may alternatively be an omni-directional antenna configured to receive or transmit signals from or to all surrounding antennas within range. In any case, auxiliary antenna 58 is configured to transmit or receive signals in a second frequency range of interest that at least partially overlaps the first frequency range associated with the main antenna 48. For example, antenna 58 may be configured as an LMU antenna operable to receive signals in a PCS band of between 1850 and 1990 MHz.

Antenna assembly 18 incorporates a number of features which alone and/or in combination serve to isolate, or enhance isolation of, the auxiliary antenna 58 from the main antenna 48, as well as from other antennas (e.g., 24, 28 and 32) mounted proximate to antenna assembly 18, to thereby reduce interference between the auxiliary beam developed by the auxiliary antenna 58 and the main beam developed by the main antenna 48, and/or to reduce interference between the auxiliary beam developed by the auxiliary antenna 58 and signals produced or received by other antennas (e.g., 24, 28 and/or 32) mounted proximate thereto. For example, referring again to FIG. 2, the auxiliary antenna 58 is decoupled from the main antenna 48 by spacing apart antenna 58 from the antenna 48 via a region or space 54, wherein antennas 48 and 58 and space 54 are oriented such that antenna 58 is spaced apart from antenna 48 via space 54 along a direction in which the signals transmitted or received by either of antennas 48 and 58 generally do not have significant energy. In the illustrated embodiment, for example, antenna 48 is configured to develop main lobe 100 illustrated in FIG. 6 and antenna 58 is configured to develop auxiliary lobe 150 illustrated in FIG. 7. In this embodiment, auxiliary antenna 48 is positioned elevationally above antenna 48 with space 54 disposed therebetween such that when the antenna assembly 18 is mounted vertically as illustrated in FIG. 1, the main beam 100 and auxiliary beam 150 are both directed generally azimuthally, and neither the main beam 100 nor the auxiliary beam 150 has significant energy in the vertical or elevational direction. Alternatively, the auxiliary antenna 58 could be positioned elevationally below antenna 48 with space 54 disposed therebetween. In either case, it will be understood that, in general, the greater the length of space 54 creating the separation of antennas 48 and 58, the greater the isolation between antennas 48 and 58 will result. As a practical matter, however, the length of space 54 will generally be dictated by the overall length requirements of antenna assembly 18, and in the illustrated embodiment, antennas 48 and 58 are physically separated via space 54 by about 10 inches.

Another feature of antenna assembly 18 that serves to isolate, or enhance isolation of, the auxiliary antenna 58 from the main antenna 48, as well as from other antennas (e.g., 24, 28 and 32) mounted proximate to antenna assembly 18, to thereby reduce interference between the auxiliary beam developed by the auxiliary antenna 58 and the main beam developed by the main antenna 48 is the inclusion of one or more radio frequency suppression structures within space 54. Referring to FIG. 3, for example, a radio frequency energy absorbing member 54' is disposed within space 54, wherein member 54' is formed of a known signal dampening or energy absorbing material operable to absorb energy in the frequency range transmitted or received by the auxiliary antenna 58. In one embodiment, member 54' is formed of a carbon-loaded foam material that is commercially available from Cuming Microwave Corporation of Boston, Mass. as product number C-RAM MT-30, although member 54' may alternatively be formed of other known radio frequency signal dampening or energy absorbing materials. In the embodiment shown, member 54' is approximately 16 inches in length (referenced to the longitudinal axis of antenna 18) and approximately 4 inches thick, although the present invention contemplates other dimensions of member 54'. In general, the size of member 54' will be proportional to its energy absorbing capability.

Figure 5:
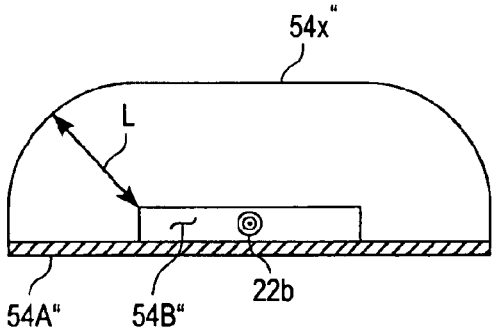
FIG. 5 is a cross-sectional view of the antenna combination of FIG. 2 viewed along section lines 5—5 illustrating a cross-section of the antenna isolation member of FIG. 4.

Alternatively, or additionally, space 54 of FIG. 2 may include a radio frequency energy scattering member operable to increase isolation between antenna 58 and antenna 48 by scattering incident radio frequency energy rather than absorbing it. Referring to FIG. 4, for example, a radio frequency energy scattering member in the form of a radio frequency choke 54" is shown disposed within space 54 adjacent to ear 64 of the ground plane or plate 56. Choke 54" comprises an electrically conductive member including a number of plates defining at least one slot therein positioned transverse to the longitudinal axis of antenna assembly 18. In one embodiment, choke 54" is formed of an electrically conductive material such as aluminum, copper, or the like, although choke 54" may alternatively be formed by applying an electrically conductive film, layer, sheet or coating over an electrically insulating or other member. Choke 54" may define therein any number, N, of plates and N-1 slots, wherein N may be any positive integer. FIG. 4 illustrates a cross section of one embodiment of choke 54" defining four such plates 54*a*"–54*d*" separated by three equal-width spaces or slots, and joined at one end by a bottom plate 54A". One embodiment 54*x*" of any one of the plates 54*a*"–54*d*" of FIG. 4 is illustrated in FIG. 5, and defines a channel 54B" therethrough adjacent bottom plate 54A', wherein channel 54B" is generally sized to receive transmission line 22*b* therethrough. A suitably sized channel 80 is formed through ear 64 of ground plane or plate 56 and signal dampening or radio frequency energy absorbing pad 68 (to be described in greater detail hereinafter), and transmission line 22*b* is routed from antenna 58 to a transmission line exit port adjacent the bottom of antenna assembly 18 through channel 80 and channel(s) 54B" of the one or more plates 54*x*". In any case, the one or more plates 54*x*" define a $\text{length}_1$ L, between an outer periphery thereof and an outer periphery of channel 54B". In one embodiment, the radio frequency choke 54" is configured as a quarter-wave choke, and the length L between channel 54B" and the outer periphery of plate 54*x*" is therefore approximately equal to one fourth of the wavelength of a selected one, or an average of, the frequency range of signals transmitted or received by antenna 58. Alternatively, the length L may be sized such that choke 54" takes on other known configurations.

Yet another feature of antenna assembly 18 that serves to isolate, or enhance isolation of, the auxiliary antenna 58 from the main antenna 48, as well as from other antennas (e.g., 24, 28 and 32) mounted proximate to antenna assembly 18, to thereby reduce interference between the auxiliary beam developed by the auxiliary antenna 58 and the main beam developed by the main antenna 48 is the electrical isolation of the ground planes associated with each of antennas 48 and 58. Referring again to FIG. 2, for example, antenna assembly 18 includes a housing or radome 74 surrounding antennas 48 and 58 as well as space 54. In one embodiment, radome 74 defines an electrically non-conductive support housing to which ground plane or plate 50 and ground plane or plate 56 are mounted. By physically uniting the two antennas 48 and 58 via an electrically non-conductive support member, ground currents are prevented from traveling between ground planes or plates 50 and 56, thereby reducing interference between antennas 48 and 58. In one embodiment, radome 74 is formed of an electrically non-conductive plastic of known composition, although other electrically non-conductive materials may be included or used to form radome 74.

Alternatively or additionally, antenna assembly 18 may include one or more electrically non-conductive elongated members 76 configured for attachment to ground plane or plate 50 and to ground plane or plate 56, as shown in phantom in FIG. 2. Either alone or in combination with radome 74, the one or more electrically nonconductive members 76 serve to physically unite antennas 48 and 58 in a manner that electrically isolates the ground planes or plates 50 and 56 from each other. The lengths and widths of electrically non-conductive members 76 may be sized to provide any desired level of support for antennas 48 and 58. In one embodiment, the one or more members 76 may be formed of an electrically non-conductive plastic of known composition, although other electrically non-conductive materials may be included or used to form the one or more members 76.

A further feature of antenna assembly 18 that serves to isolate, or enhance isolation of, the auxiliary antenna 58 from the main antenna 48, as well as from other antennas (e.g., 24, 28 and 32) mounted proximate to antenna assembly 18, to thereby reduce interference between the auxiliary beam developed by the auxiliary antenna 58 and the main beam developed by the main antenna 48 or other proximate antennas is the inclusion of radio frequency energy absorbing members positioned about the auxiliary antenna 58. Referring again to FIG. 2, for example, antenna assembly 18 includes a first signal dampening or radio frequency energy absorbing pad 68 of known construction affixed to the inner face of ear 64, and a second signal dampening or radio frequency energy absorbing pad 66 of known construction affixed to the inner face of ear 62 (see also FIGS. 3 and 4). Third and fourth signal dampening or energy absorbing pads 70 and 72, of known construction, are affixed to the inner face of the bottom portion of the ground plane or plate 56 on either side of antenna 58. In one embodiment, the signal dampening or radio frequency energy absorbing pads 66, 68, 70 and 72 are formed of a flexible, rubber-like sheet material that is commercially available from Cuming Microwave Corporation of Boston, Mass. as product number C-RAM FLX-2.0, although pads 66, 68, 70 and 72 may alternatively be formed of other known radio frequency signal dampening or energy absorbing materials. In any case, pads 66, 68, 70 and 72 are, in the embodiment shown, affixed to their corresponding structures with a known adhesive, although the present invention contemplates that pads 66, 68, 70 and 72 may alternatively be affixed as just described using any known technique.

The signal dampening or energy absorbing pads 66, 68, 70 and 72 are selectively affixed to the ground plane or plate 56 about the antenna 58 to absorb energy received or radiated by antenna 58 in specific directions to thereby isolate antenna 58 from the one or more antennas (e.g., 24, 28 and 32) mounted to the tower 12 (see FIG. 1). As with the signal dampening or radio frequency energy absorbing member 54" described hereinabove, the signal dampening or radio frequency energy absorbing material used for pads 66, 68, 70 and 72 should be chosen to absorb or dampen energy in the frequency range of the signals transmitted or received by the antenna 58.

It should be noted that the transmission line 22*b* extending from antenna 58 is routed through channel or bore 80 defined through ear 64 and pad 68 as illustrated in FIG. 2. In embodiments of antenna assembly 18 including radio frequency energy absorbing member 54', bore 80 may extend through member 54', as illustrated in FIG. 3. In embodiments of antenna assembly 18 including radio frequency energy scattering member 54", transmission line 22*b* is routed through bore 80 defined through ear 64 and pad 68 adjacent to the channels 54"B defined through the one or more plates 54*x*" (see FIGS. 4 and 5). In either case, thusly routing transmission line 22*b* allows pad 68 and member 54' and/or member 54" to absorb energy radiated by transmission line 22*b* and thereby further isolate operation of the antenna 58 from that of antenna 48. The location of bore 80 relative to pad 68, member 54' and/or member 54" may vary, although it is desirable to select the location of bore 80 in a manner that minimizes transfer of energy from antenna 58 and/or transmission line 22*b* to antenna 48.

Yet a further feature of antenna assembly 18 that serves to isolate, or enhance isolation of, the auxiliary antenna 58 from the main antenna 48, as well as from other antennas (e.g., 24, 28 and 32) mounted proximate to antenna assembly 18, to thereby reduce interference between the auxiliary beam developed by the auxiliary antenna 58 and the main beam developed by the main antenna 48 is the configuration and number of radiator elements of the auxiliary antenna 58. Referring again to either of FIG. 3 or 4, for example, the pattern and spacing between radiator elements 92 and 94 of antenna 58 are selected to enhance isolation of the LMU antenna 58 from the base station antenna 48. Specifically, the shapes and spacing of radiator elements 92 and 94 relative to each other are designed such that the energy radiated by each is 180 degrees out of phase with the other along the longitudinal axis of antenna 18, thereby causing the resulting signal received by radiator elements 92 and 94 to be substantially suppressed in the direction of the base station antenna 48. As a result of this phasing relationship between radiator elements 92 and 94, energy transmitted by antenna 58 will be isolated from, and not interfere with, the operation of antenna 48. Those skilled in the art will recognize that other structures and/or positioning of the base antenna 48 may be used within antenna 18. In such cases, the number of, as well as the shapes and spacing between, antenna radiator elements 92 and 94 may be selected so as to substantially suppress energy radiation in the direction of antenna 48 to thereby enhance isolation therebetween as just described, and such alteration of the shapes of, and/or spacing between, radiator elements 92 and 94 are intended to fall within the scope of the present invention.

While the invention has been illustrated and described in detail in the foregoing drawings and description, the same is to be considered as illustrative and not restrictive in character, it being understood that only illustrative embodiments thereof have been shown and described and that all changes and modifications that come within the spirit of the invention are desired to be protected.

What is claimed is:

1. An antenna structure comprising:

an electrically non-conductive support structure;

mounted on said support structure, a base station antenna comprising at least one radiator supported adjacent a first ground plane, said at least one radiator configured to transmit or receive signals in a first frequency range and to develop a main beam substantially wider in azimuth than in elevation;

mounted on said support structure and spaced elevationally above or below said base station antenna, an auxiliary antenna comprising at least one radiator supported adjacent a second ground plane isolated from said first ground plane, said auxiliary antenna configured to transmit or receive signals in a second frequency range overlapping said first frequency range and to develop an auxiliary beam at least partially overlapping said main beam azimuthally; and a radio frequency energy suppressor disposed between said base station and auxiliary antennas.

2. The system of claim 1 wherein said auxiliary antenna comprises an LMU antenna.

3. The system of claim 1 wherein said auxiliary beam is omni-directional.

4. The system of claim 1 wherein said radio frequency energy suppressor comprises a radio frequency energy absorbing member.

5. The antenna assembly of claim 4 wherein said radio frequency energy absorbing member is formed of a material operable to absorb energy in said second frequency range.

6. The antenna assembly of claim 1 wherein said radio frequency energy suppressor comprises a radio frequency energy scattering member.

7. The antenna assembly of claim 6 wherein said radio frequency energy scattering member is a radio frequency choke.

8. The antenna assembly of claim 7 wherein said radio frequency choke comprises a body defining at least one slot between a pair of electrically conductive plates each defining a channel therethrough, each of said plates defining a length of about one-quarter of the wavelength of said second frequency range between an outer periphery thereof and an outer periphery of said channel.

9. The antenna assembly of claim 1 wherein said radio frequency energy suppressor includes a radio frequency energy absorbing member and a radio frequency energy scattering member.

10. The antenna assembly of claim 9 wherein said radio frequency energy absorbing member is formed of a material operable to absorb energy in said second frequency range;

and wherein said radio frequency energy scattering member comprises a radio frequency choke having a body defining at least one slot between a pair of electrically conductive plates each defining a channel therethrough, each of said plates defining a length of about one-quarter of the wavelength of said second frequency range between an outer periphery thereof and an outer periphery of said channel.

11. The antenna assembly of claim 1 wherein said base station antenna is mounted to said first ground plane and said auxiliary antenna is mounted to said second ground plane.

12. The antenna structure of claim 1 wherein said electrically non-conductive support structure comprises an electrically non-conductive radome surrounding said base station and auxiliary antennas and mounted to said first and second ground planes.

13. The antenna structure of claim 1 wherein said electrically non-conductive support structure includes at least one electrically non-conductive elongated member interconnecting said first and second ground planes.

14. The antenna structure of claim 1 wherein said auxiliary antenna includes a radiator structure configured to suppress signals radiated thereby in the direction of said base station antenna so as to enhance isolation between said main and auxiliary beams.

15. The antenna structure of claim 1 further including energy absorbing material surrounding said auxiliary antenna.

16. The antenna structure of claim 15 wherein said energy absorbing material is operable to absorb energy in said second frequency range.

* * * * *